United States Patent [19]

Gaston et al.

[11] Patent Number: 4,584,863

[45] Date of Patent: Apr. 29, 1986

[54] AUTOMOBILE BODY REPAIR TOOL

[75] Inventors: Claire F. Gaston, Des Moines, Iowa; George L. Steck, Dayton, Ohio; Raymond E. Steck, Miamisburg, Ohio; Laurence D. Steck, Dayton, Ohio

[73] Assignee: Steck Manufacturing Company, Inc., Dayton, Ohio

[21] Appl. No.: 742,038

[22] Filed: Jun. 6, 1985

[51] Int. Cl.[4] ..... B21D 1/12

[52] U.S. Cl. ..... 72/477; 24/230.5 R; 72/705

[58] Field of Search ..... 24/230.5 AD, 230.5 R; 72/477, 705; 294/92

[56] References Cited

U.S. PATENT DOCUMENTS

| | | | |
|---|---|---|---|
| 1,031,964 | 7/1912 | Reinehr | 294/92 |
| 1,367,818 | 2/1921 | Kennedy . | |
| 1,850,073 | 3/1932 | Countryman . | |
| 2,165,504 | 7/1939 | Pfauser . | |
| 2,352,703 | 7/1944 | Fries, Jr. . | |
| 2,627,295 | 2/1953 | Jackson | 72/705 |
| 2,651,539 | 9/1953 | Poisal | 24/230.5 R |
| 2,764,215 | 9/1956 | Adams et al. . | |
| 2,788,831 | 4/1957 | Weiner . | |
| 3,108,629 | 10/1963 | Jenkins . | |
| 3,149,659 | 9/1964 | Bogert | 72/705 |
| 3,501,941 | 3/1970 | Long . | |
| 3,556,482 | 1/1971 | Whitney | 72/705 |
| 3,577,881 | 5/1971 | Markovics . | |
| 3,625,046 | 12/1971 | VanGompel . | |
| 3,760,625 | 9/1973 | Archambault | 72/705 |
| 3,824,676 | 7/1974 | Ebert | 294/92 |
| 4,000,639 | 1/1977 | Postema . | |
| 4,120,189 | 10/1978 | Jones | 24/230.5 R |
| 4,358,946 | 11/1982 | Gallart . | |

*Primary Examiner*—Lowell A. Larson

*Attorney, Agent, or Firm*—Floyd A. Gonzalez

[57] ABSTRACT

An automobile body repair tool which includes aligned, spaced apart "U" shaped members having bight portions, a work engaging member spanning and attached to the spaced apart "U" shaped members so as to engage a panel member, or the like, of an automobile body having an open edge in said bight portions, and a force transmitting member spanning and attached to the "U" shaped members on the side opposite the work engaging member. When a lateral force is applied to the force transmitting member, an even, straightening force is applied along the face of the work engaging member to one side of the panel member in the bight portions.

15 Claims, 9 Drawing Figures

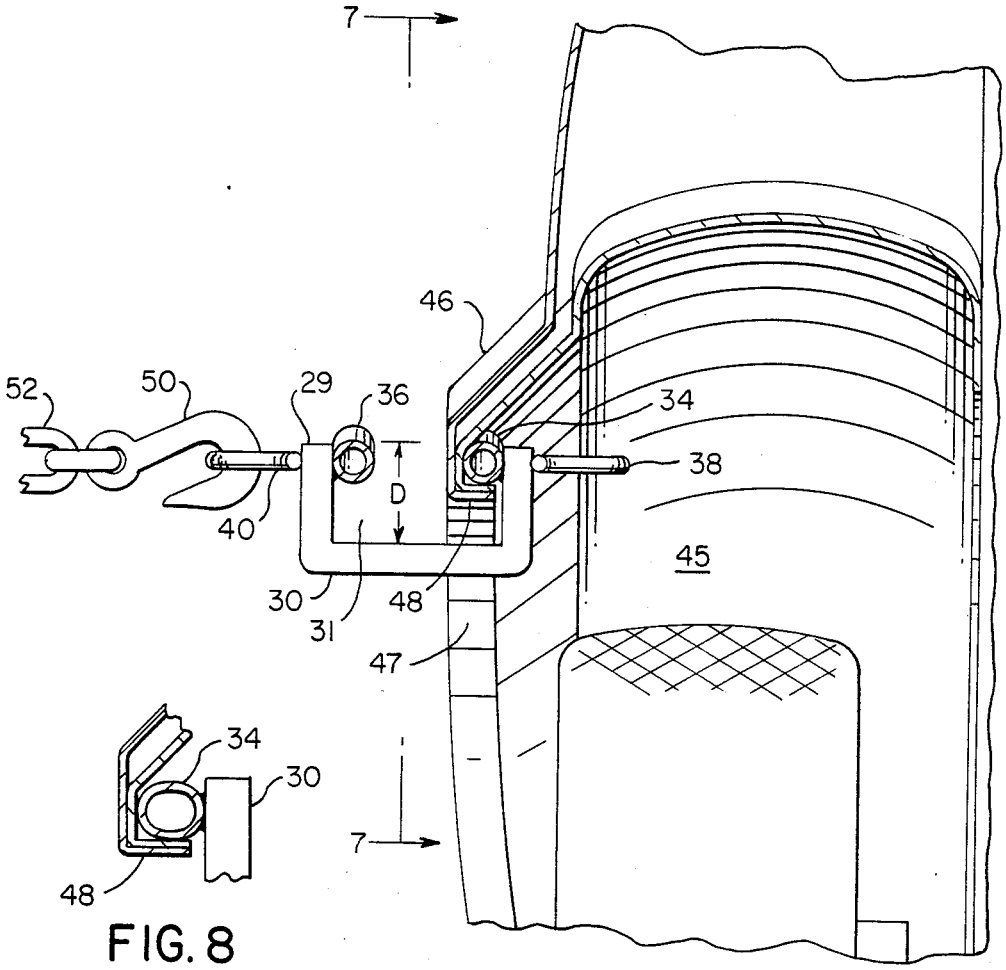
FIG. 8
FIG. 6
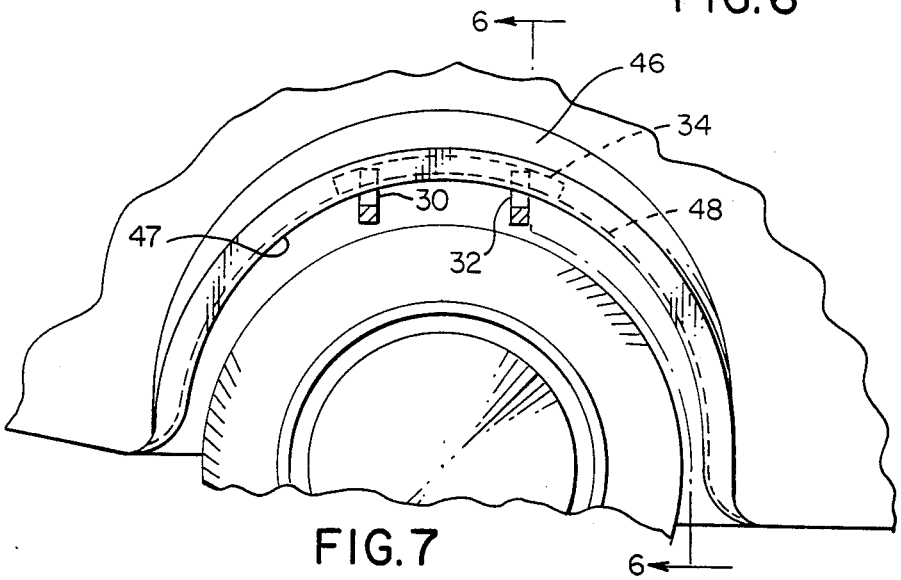
FIG. 7

AUTOMOBILE BODY REPAIR TOOL

BACKGROUND OF THE INVENTION

This invention is related to repair tools for the repair of damaged automobile bodies, and is more particularly related to repair tools for repairing damaged portions having open edges such as quarter panels and wheel wells of automobile bodies.

In the past, automobiles included a frame to which components of the body were attached. If a portion of the body was damaged, it could be replaced, or if it was to be repaired, a jack or pry bar could be placed between the frame and the damaged portion, and force applied to bend the damaged portion back to a normal shape. However, in many modern automobiles the body members are welded together in a unit body construction such that there is no frame against which a pry bar or jack may be positioned. If a hook or bar is used to apply pulling force to a damaged portion of a unit body, the body will yield at the point where the force is applied, resulting in a bulge or wrinkle in the body at the point of repair.

U.S. Pat. No. 1,850,073 issued Mar. 22, 1932 to Countryman for Automobile Repair Tool discloses a repair tool for straightening a fender or other parts of the body of an automobile. The Countryman device includes a part having means for holding the tire of a wheel, a part having means for gripping a fender, and means for moving the parts with relationship to each other for applying a longitudinal force for straightening the fender. The means for gripping the fender includes an arm having a slot for receiving the work to be operated on, and a pivoted leg which cooperates with one side of the slot for gripping and holding within the slot, the article worked upon.

U.S. Pat. No. 3,577,881 issued May 11, 1971 to Markovics for Portable Highway Crash Rescue Unit discloses a portable rescue unit which includes a base leg, a vertical actuated arm pivotally mounted to the base, an elongated power unit extending from the base to the side of the actuating arm including a support abutment adapted to engage the vehicle frame, and a cable or chain having either a hook or a door piercing spike on its end. in use, the hook or spike is engaged with a door post or door, and the power unit is activated to pull the door post outward or pry open the door to facilitate the extraction of a victim from a wrecked vehicle.

U.S. Pat. No. 3,108,629 issued Oct. 29, 1963 to Jenkins for Body Clamp discloses a clamp which may be clamped by locking means to an automobile body to allow repair pulls to be made to a damaged automobile body. In use, two of the disclosed body clamps may be used in combination with standard tools found in automobile repair garages, to repair damaged automobile bodies having a unit welded body which requires stretching along a side-to-side line, or along a forward-to-rearward line by pushing or pulling one side relative to an opposing side. The body clamp of the Jenkins patent is used to anchor one side relative to the opposing side, so that the opposing side may be restored to its normal shape.

U.S. Pat. No. 2,165,504 issued July 11, 1939 to Pfauser for Portable Hydraulic Metal Straightening Machine discloses a machine which utilizes a hydraulic ram to force various parts apart or together, as the case may be, to straighten or reshape bent or deformed frames, bodies, fenders, etc. FIG. 11 of the Pfauser patent discloses an embodiment having a hydraulic ram blocked on one side and spaced from a metal piece to be straightened, a member positioned behind the metal piece, and a chain hooked in slots in the member and passing over the ram such that when the ram is extended the chain pulls the member, thereby, applying straightening force to the metal piece.

Other U.S. Patents which show the state of the art include U.S. Pat. Nos. 1,367,818 issued Feb. 8, 1921 to Kennedy for Metal Working Tool; 2,352,703 issued July 4, 1944 to Fries, Jr. for Expander; 2,788,831 to Weiner for Apparatus for Straightening Metallic Vehicle Bumpers; 2,764,215 issued Sept. 25, 1956 to Adams et al. for Wheel Straightening Attachment; 3,501,941 issued Mar. 24, 1970 to Long for Straightener for Posts and the Like; 3,625,046 issued Dec. 7, 1971 to Van Gompel for Apparatus and Method for Straightening Deformed Rolls of Sheet Stock; 4,000,639 issued Jan. 4, 1977 to Postema for Tool and Method for Trueing Wheel Rims; and 4,358,946 issued Nov. 16, 1982 to Gallart for Power Tool.

SUMMARY OF THE INVENTION

The present invention is an automobile body repair tool which includes aligned, spaced apart "U" shaped members having bight portions, a work engaging member spanning and attached to the spaced apart "U" shaped members so as to engage a work piece positioned in the bight portion of the "U" shaped members, and a force transmitting member spanning and attached to the "U" shaped members on the sides opposite the work engaging member. When a lateral force is applied to the force transmitting member, an even, straightening force is applied along the face of the work engaging member to one side of the work piece. The work piece is a panel member, or the like, of an automobile body having an open edge, such as the trunk opening or the wheel well of the body. The work engaging member is preferably shaped, such as in a curve, to accommodate the opening of the automobile body with which the repair tool is to be used. One embodiment of the repair tool has oppositely facing work engaging members, each having a different shape, and corresponding force transmitting member arranged such that a desired one of the work engaging members may be selected for applying a straightening force to an automobile body by reversing the tool.

It is a primary object of the present invention to provide a repair tool for repairing automobile bodies which is used to provide an evenly distributed straightening force to a portion of an automobile body.

It is another object of the present invention to provide a repair tool which may be used with lateral force applying tools readily available in an automobile body repair shop.

It is another object of the present invention to provide a repair tool having a work engaging member generally shaped to accomodate the shape of an opening of the automobile body to be repaired.

It is another object of the present invention to provide a repair tool having a pair of work engaging members, one of which may be selected by reversing the tool.

It is another object of the present invention to provide a repair tool having a pair of work engaging members, each having a separate shape for accomodating different shaped openings of automobile bodies to be repaired.

These and other objects of the present invention will become apparent from the preferred embodiments and drawings disclosed herein.

BRIEF DESCRIPTION OF THE DRAWINGS

FIG. 6 is a fragmentary view of an automobile body having straightening force applied thereto by the embodiment of FIG. 4;

FIG. 7 is a front view of embodiment of FIG. 4 used as shown in FIG. 6 viewed along section line 7—7 of FIG. 6, and wherein section line 6—6 represents the view of FIG. 6, and FIG. 8 is a fragmentary view of FIG. 6 showing an optional shape of a work engaging member of the embodiment of FIG. 4.

DESCRIPTION OF THE PREFERRED EMBODIMENTS

Figure 1:
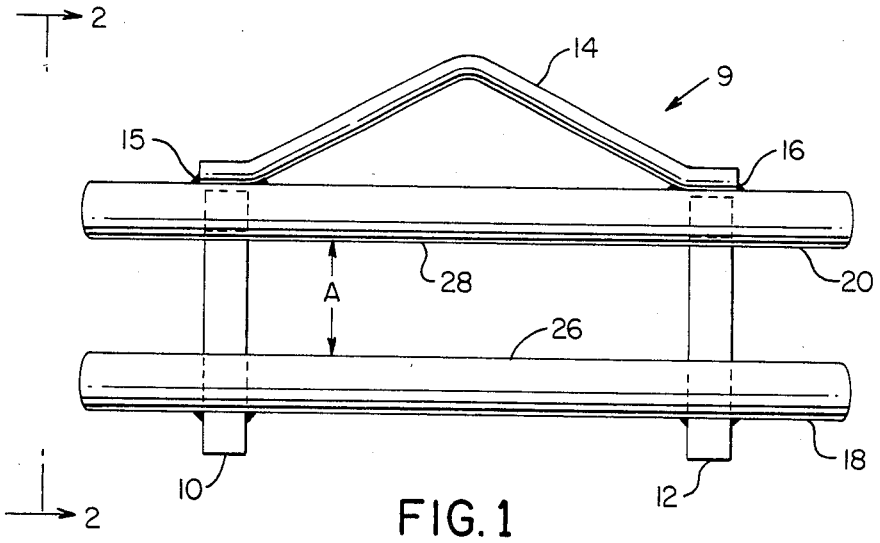
FIG. 1 is a top view of a first embodiment of the invention.

FIG. 1 is a top view of a first embodiment 9 of a repair tool of the present invention, and includes aligned, spaced apart support members 10 and 12, and a curved work engaging member 18 spanning and firmly attached, such as by welding, to the spaced apart support members 10 and 12. A frame member 20 is provided which spans and is firmly attached, also by welding, to the spaced apart members 10 and 12 to give rigidity to the repair tool during use. A member 14 for attaching a pulling force is connected at its ends 15 and 16 to the frame member, 20.

Figure 2:
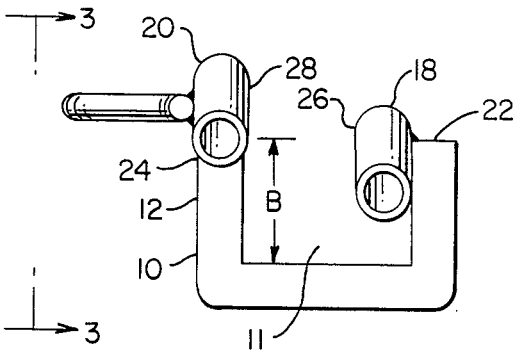
FIG. 2 is an end view of the embodiment of FIG. 1 taken along lines 2—2 of FIG. 1.

FIG. 2 is a left end view of the repair tool taken along line 2—2 of FIG. 1, and shows the support member 10 having a generally "U" shape defining a work receiving bight portion 11. It will be understood that support member 12 is aligned behind support member 10 and has a similar bight portion. The curved member 18 is welded to the inside of one upraised arm 22 of the support member 10, and the inside of a corresponding upraised arm of support 12 (see FIG. 1). The frame member 20 is welded across the top of the upraised arm 24 of the support member 10, and also across the top of a corresponding upraised arm of the support member 12 (FIG. 1).

Figure 3:
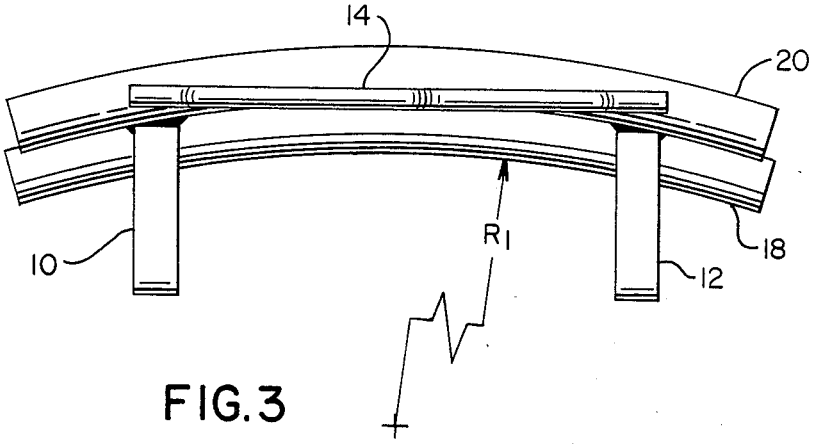
FIG. 3 is a front view of the embodiment of FIGS. 1 and 2 taken along lines 3—3 of FIG. 2.

FIG. 3 is a front view of the repair tool taken along line 3—3 of FIG. 2, and more clearly shows the curvature of the curved member 18 in the vertical plane. The radius of curvature R of the curved member 18 is about 24 inches (61 cm), which is selected to fit the wheel wells of most American made cars, and many foreign made cars. Frame member 20 is shown as having the same radius of curvature as curved member 18. Since the frame member 20 of the embodiment 9 of FIGS. 1-3 is provided to add rigidity, it may have any radius of curvature. The same radius is used for members 18 and 20 of the embodiment of FIGS. 4 1-3 for convenience since members of two different curvatures need not be fabricated. The support members 10 and 12 are spaced about 7 inches (18 cm) apart.

The distance A in FIG. 1 from the face 26 of the curved member 18 to the opposite face 28 of the frame member 20 is about 1½ inches (3.8 cm), while the depth B in FIG. 2 of the bight portion 11 is about 2 inches (5.1 cm) for allowing the edge of a panel of an automobile body, such as a trunk opening or a wheel well, to be placed between the face 26 of the curved member 18 and the opposite face 28 of the frame member 20. The procedures for repairing quarter panel wheel wells of damaged automobiles with the repair tool will be more fully explained later.

Figure 4:
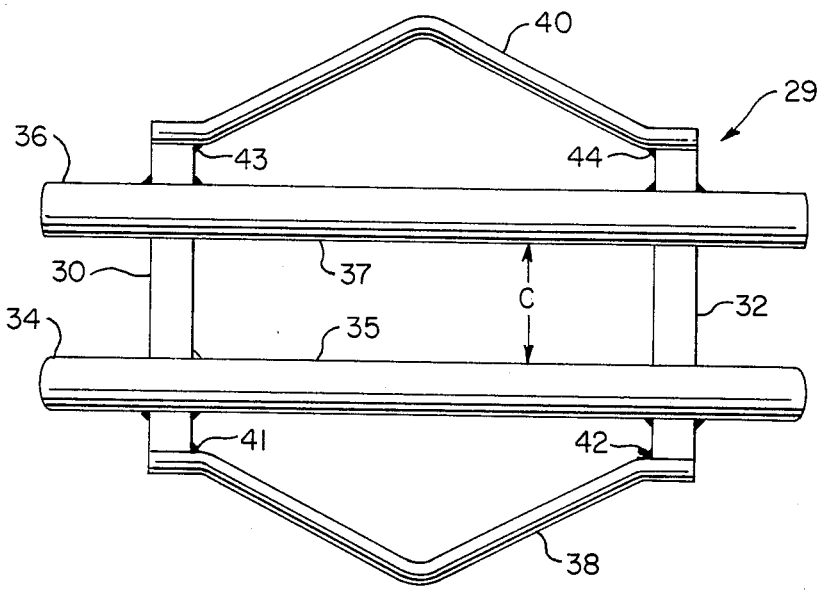
FIG. 4 is a top view of a second embodiment of the invention.

FIG. 4 is a top view of a second embodiment 29 of a repair tool of the present invention, and includes spaced apart support members 30 and 32, work engaging curved members 34 and 36 which span and are firmly attached to support members 30 and 32, and bent members 38 and 40 which span and are firmly attached at their ends 41 and 42, and 43 and 44 respectively to the support members 30 and 32. The bent members 38 and 40 are provided for attaching laterally applied pulling force to the repair tool in effecting a repair, as will be explained.

Figure 5A:
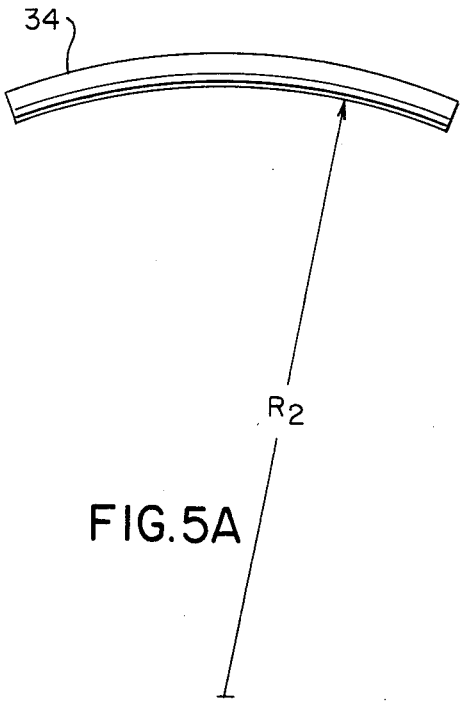
FIGS. 5A and 5B are front views of work engaging members of the embodiment of FIG. 4.
Figure 5B:
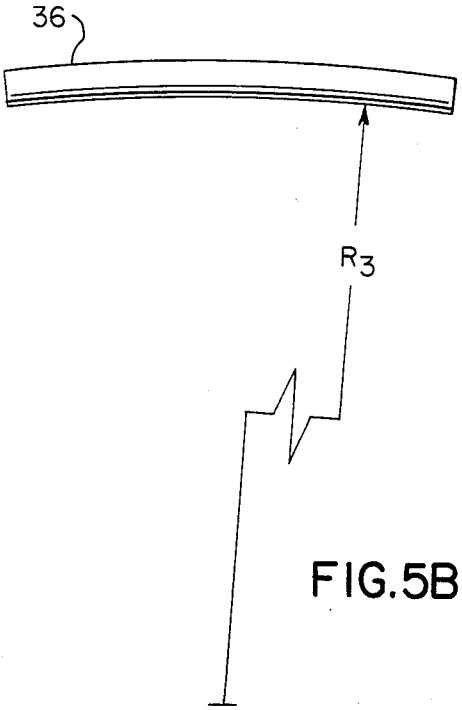

FIG. 5A is a side view of one of the bent members 34 which is of 0.84 inch OD (2.1 cm) pipe bent to have a 16 inch (40.6 cm) radius R2. FIG. 5B is a side view of the other bent member 36 which is of 0.84 inch OD (2.1 cm) pipe bent to have a 50 inch (127 cm) radius R3.

FIG. 6 is a left end view of the embodiment of FIG. 4, in which a portion of the tool 29 is placed in a wheel well 45 of an automobile whose fender 46 is to be repaired. The support members 30 and 32 are generally "U" shaped, each defining a bight portion 31 for receiving the edge of a work piece of an automobile body to be repaired. The support members 30 and 32 are spaced about 7 inches (18 cm) apart. In use, the tool 29 is turned such that the curved member most closely matching the curve of the wheel opening 47 is on the inside of the wheel well 45 to engage the inside of the fender 46 during repair. In the case illustrated in FIGS. 6 and 7, the curved member 34 is placed on the inside of the wheel well 45 above a lip 48 formed by the edge seam of the wheel opening 47. A hook 50 on the end of a chain 52 is hooked over the bent member 40, and a lateral pulling force is applied to the chain 57. In this manner, an evenly applied pulling force may be applied to the inside of the fender 46 along the face of the curved member 34, to pull a damaged quarter panel and a wheel well laterally outwardly without bulging.

Returning to FIG. 4, the distance C from the face 35 of curved member 34 to the face 37 of curved member 36 is about 1½ inches (3.8 cm). Referring to FIG. 6, the depth D of the bight portion 31 is about 2 inches (5.1 cm).

FIG. 7 is a fractional view of the rear quarter of an automobile with the repair tool 29 in place, wherein FIG. 7 is taken along section line 7—7 of FIG. 6. The curved member 34 having the smaller radius of curvature R3, has been turned to the inside of the wheel well 45, and placed on the inside of the fender 46 above the lip 48, (see FIG. 6). It will be understood that if the wheel well of the automobile being repaired was nearly straight or had little curvature, the repair tool 29 could be turned with the straighter curved member 36 turned to the inside. Returning to FIGS. 6 and 7, the hook 50 is hooked over the bent member 40, and a lateral pulling force is applied using any of the readily available pulling tools available in a automobile body shop, to include hydraulic rams, come-alongs, winches, etc. It will be understood that the repair tool 29 thus provides two curvatures, either of which may be applied to the inside of a wheel well, thus providing a satisfactory fit for almost any wheel well desired.

Referring to FIG. 8, the pipe forming the curved member 34 or 36 may optionally be slightly flatened to give a longer dimension in the horizontal direction. This will give the repair tool a longer reach so that it may be used with fenders having deeper lip construction without having to use larger diameter pipes in the constructin of the repair tool.

It will be understood that the embodiment of FIGS. 1–3 provides a repair tool of a simpler design, whose curved member 18 has a radius of curvature which is a compromise to allow the repair tool 9 to be used with many automobile wheel wells, but not as many as the repair tool 29 of FIGS. 4–7. It will also be understood that the repair tool 9 of FIGS. 1–3 will be used in the same manner as the use of the repair tool 29 shown in FIGS. 6 and 7.

Even though the dimensions and illustrative example has been directed to the repair of wheel wells and fenders, it will be understood that the dimensions of the repair tool 9 of FIGS. 1–3, or the repair tool 29 of FIGS. 4–5 may be increased or decreased to fabricate a repair tool for any panel or portion of an automobile body having an open edge, such as the trunk openings, bumpers, or the like. The work engaging members may also be variously shaped to accomodate the panel being repaired or straightened.

Thus, embodiments of a repair tool have been described which provide the aforementioned objects. It will be understood by those skilled in the art that the disclosed embodiments are exemplary only, and that the various elements disclosed may be replaced by equivalents without departing from the invention hereof, which equivalents are intended to be covered by the appended claim.

What is claimed is:

1. An automobile body repair tool comprising:

support means having two aligned, spaced apart, generally "U" shaped members, each having two arms and a connecting portion defining bight portions for receiving the edge of a work piece;

work engaging means spanning said generally "U" shaped members and attached to one arm of each of said generally "U" shaped members on one side of said bight portions, said support means for engaging one side of the work piece in said bight portions; and lateral force transmitting means attached to said support means for transmitting lateral force to said work engaging means thereby applying force along said one side of the work piece in said bight portions.

2. The automobile body repair tool of claim 1 wherein said work engaging means comprises a curved member being curved in a plane parallel to the plane of the longitudinal sides of the arms of said "U" shaped members.

3. The automobile body repair tool of claim 2 wherein said curved member is attached to the inward facing sides of said arms.

4. The automobile body repair tool of claim 3 wherein said lateral force transmitting means comprises a bent member spanning and attached to the outward facing sides of the other corresponding arms of said "U" shaped members.

5. The automobile body repair tool of claim 4 wherein said lateral force transmitting means further comprises a frame member spanning and attached to said other corresponding arms of said "U" shaped members.

6. The automobile body repair tool of claim 4 wherein said work engaging means further comprises a second curved member spanning and attached to the inward facing sides of said other corresponding arms of said "U" shaped members, said second work engaging curved member being curved in a plane parallel to the plane of the longitudinal sides of the arms of said "U" shaped members.

7. The automobile body repair tool of claim 6 wherein said lateral force transmitting means further comprises a second bent member spanning and attached to the outward facing sides of said corresponding ones of said arms of said "U" shaped members.

8. The automobile body repair tool of claim 2 wherein the said curved member is flatened thereby increasing the horizontal dimension of said curved member.

9. The automobile body repair tool of claim 2 wherein the radius of curvature of said curved member varies from about 50 inches (127 cm) to about 16 inches (40.6 cm).

10. An automobile repair tool comprising:

a pair of aligned, spaced apart "U" shaped members, each having two arms and a connecting portion forming a bight portion;

a work engaging member spanning corresponding ones of the arms of said "U" shaped member for engaging one side of a work piece in said bight portions; and a force transmitting member spanning the corresponding other arms of said "U" shaped members such that lateral force applied to said force transmitting means applies straightening force along said work engaging member to one side of the work piece in said bight portions.

11. The automobile repair tool of claim 10 wherein said work engaging means has a curve for accommodating the shape of the work piece in said bight portions.

12. The automobile repair tool of claim 10 wherein said curve has a radius of curvature of about 24 inches (61 cm.).

13. An automobile repair tool comprising:

a pair of aligned, spaced apart "U" shaped members, each having two arms and a connecting portion forming a bight portion;

a work engaging member spanning corresponding ones of the arms of said "U" shaped member for engaging one side of a work piece in said bight portions, said work engaging member having a first curve for accommodating the shape of the work piece in said bight portions;

a force transmitting member spanning the corresponding other arms of said "U" shaped members such that lateral force applied to said force transmitting means applies straightenting force along said work engaging member to one side of the work piece in said bight portions;

a second work engaging member spanning said corresponding other arms of said "U" shaped members for engaging one side of a work piece in said bight portions, said work engaging member having a second curve; and a second force transmitting member spanning the corresponding other arms of said "U" shaped members such that lateral force applied to said second transmitting means applies straightening force along said second work engaging member to one said of the work piece in said bight portions, wherein said automobile repair tool may be reversed to select one of said work engaging members to engage the work piece.

14. The automobile repair tool of claim 13 wherein said first curve has a radius of curvature of about 16 inches (40.68 cm.), and the other of said curves has a radius of curvature of about 50 inches (127 cm.).

15. The automobile repair tool of claim 13 wherein one of said curves has a radius of curvature of about 24 inches (61 cm.).

* * * * *